US010865650B2

(12) United States Patent
Stevens et al.

(10) Patent No.: US 10,865,650 B2
(45) Date of Patent: Dec. 15, 2020

(54) STATOR VANE SUPPORT WITH ANTI-ROTATION FEATURES

(71) Applicant: UNITED TECHNOLOGIES CORPORATION, Farmington, CT (US)

(72) Inventors: Michael S. Stevens, Alfred, ME (US); Tomasz Pelic, Krzemienica (PL)

(73) Assignee: Raytheon Technologies Corporation, Farmington, CT (US)

( * ) Notice: Subject to any disclaimer, the term of this patent is extended or adjusted under 35 U.S.C. 154(b) by 298 days.

(21) Appl. No.: 15/702,564

(22) Filed: Sep. 12, 2017

(65) Prior Publication Data

US 2019/0078451 A1 Mar. 14, 2019

(51) Int. Cl.
*F01D 9/04* (2006.01)
*F01D 25/24* (2006.01)

(52) U.S. Cl.
CPC ..... *F01D 9/042* (2013.01); *F01D 9/041* (2013.01); *F01D 25/246* (2013.01); *F05D 2220/32* (2013.01); *F05D 2230/642* (2013.01); *F05D 2240/12* (2013.01); *F05D 2260/30* (2013.01)

(58) Field of Classification Search
CPC ..... F01D 9/041; F01D 9/042; F01D 25/246; F05D 2220/32; F05D 2230/642; F05D 2240/12; F05D 2260/30
See application file for complete search history.

(56) References Cited

U.S. PATENT DOCUMENTS 5,004,402 A 4/1991 Burchette et al.
5,961,278 A * 10/1999 Dorais ..... F01D 9/042 415/137
8,794,911 B2 8/2014 Murphy et al.
2004/0170499 A1* 9/2004 Powis ..... B22C 21/14 416/97 R (Continued)

FOREIGN PATENT DOCUMENTS

EP 1104836 6/2001
FR 2995340 3/2014

(Continued)

OTHER PUBLICATIONS

European Patent Office, European Search Report dated Jan. 21, 2019 in Application No. 18193001.7.

*Primary Examiner* — Michael Lebentritt
*Assistant Examiner* — Jesse M Prager
(74) *Attorney, Agent, or Firm* — Snell & Wilmer L.L.P.

(57) ABSTRACT

A stator vane support with anti-rotation features is provided. The stator vane support may comprise an inner diameter surface opposite an outer diameter surface. The stator vane support may comprise an anti-rotation lug defining a protrusion extending inward from the inner diameter surface. The stator vane support may have a first recess defining a first void on the inner diameter surface proximate a first surface of the anti-rotation lug. The stator vane support may have a second recess defining a second void on the inner diameter surface proximate a second surface of the anti-rotation lug. The anti-rotation lug may be configured to interface with a stator vane to at least partially limit circumferential movement, and each recess may be configured to allow the stator vane to thermally expand during gas turbine engine operation.

10 Claims, 3 Drawing Sheets

(56) References Cited

U.S. PATENT DOCUMENTS

| | | | | |
|---|---|---|---|---|
| 2014/0219791 | A1* | 8/2014 | Richardson | F01D 25/246<br>415/209.2 |
| 2015/0240724 | A1* | 8/2015 | Low | F01D 9/023<br>60/722 |
| 2016/0208629 | A1* | 7/2016 | Bergman | F01D 11/08 |
| 2016/0326896 | A1* | 11/2016 | Jamison | F01D 5/284 |
| 2017/0089209 | A1* | 3/2017 | Fentem | F01D 9/042 |

FOREIGN PATENT DOCUMENTS

| | | |
|---|---|---|
| WO | 9931357 | 6/1999 |
| WO | 2014052220 | 4/2014 |

* cited by examiner

STATOR VANE SUPPORT WITH ANTI-ROTATION FEATURES

FIELD

The present disclosure relates to gas turbine engines, and more specifically, to a stator vane support having anti-rotation features for a gas turbine engine.

BACKGROUND

Gas turbine engines typically include a fan section to drive inflowing air, a compressor section to pressurize inflowing air, a combustor section to burn a fuel in the presence of the pressurized air, and a turbine section to extract energy from the resulting combustion gases. The fan section may include a plurality of fan blades coupled to a fan hub. The compressor section and the turbine section typically include a series of alternating rotors (blades) and stators.

SUMMARY

In various embodiments, a stator vane support is disclosed. The stator vane support may comprise an inner diameter surface opposite an outer diameter surface; an anti-rotation lug defining a protrusion extending from the inner diameter surface, wherein the anti-rotation lug comprises a first surface opposite a second surface; a first recess defining a first void on the inner diameter surface proximate the first surface of the anti-rotation lug, the first recess having a first inner surface; and a second recess defining a second void on the inner diameter surface proximate the second surface of the anti-rotation lug, the second recess having a second inner surface.

In various embodiments, the stator vane support may comprise a first support recess thickness defining a first distance from the first inner surface of the first recess to the outer diameter surface, and wherein the first support recess thickness may comprise at least a minimum thickness. The first recess may be sized and shaped to maintain the minimum thickness of the first support recess thickness. The stator vane support may comprise a second support recess thickness defining a second distance from the second inner surface of the second recess to the outer diameter surface, and wherein the second support recess thickness may comprise at least the minimum thickness. The second recess may be sized and shaped to maintain the minimum thickness of the second support recess thickness. At least one of the first inner surface of the first recess or the second inner surface of the second recess may comprise a flat surface relative to the inner diameter surface. At least one of the first inner surface of the first recess or the second inner surface of the second recess may comprise hemispherical shape relative to the inner diameter surface.

In various embodiments, a turbine assembly is disclosed. The turbine assembly may comprise a stator vane having an anti-rotation end, and a vane support. The vane support may comprise an inner diameter surface opposite an outer diameter surface; an anti-rotation lug defining a protrusion extending from the inner diameter surface, wherein the anti-rotation lug comprises a first surface opposite a second surface, and wherein the anti-rotation lug is configured to interface with the anti-rotation end of the stator vane; a first recess defining a first void on the inner diameter surface proximate the first surface of the anti-rotation lug, the first recess having a first inner surface; and a second recess defining a second void on the inner diameter surface proximate the second surface of the anti-rotation lug, the second recess having a second inner surface.

In various embodiments, the anti-rotation end of the stator vane may comprise a first protrusion and a second protrusion extending radially from the anti-rotation end towards the vane support, wherein the first protrusion and the second protrusion may define an anti-rotation void. The anti-rotation lug of the vane support may be configured to interface with the anti-rotation void of the stator vane to at least partially limit rotation of the stator vane relative to the vane support. In response to the anti-rotation lug interfacing with the anti-rotation void, the first protrusion may be configured to interface with the first recess and the second protrusion may be configured to interface with the second recess. The vane support may comprise a first support recess thickness defining a first distance from the first inner surface of the first recess to the outer diameter surface, and wherein the first support recess thickness may comprise at least a minimum thickness. The first recess may be sized and shaped to maintain the minimum thickness of the first support recess thickness. The vane support may comprise a second support recess thickness defining a second distance from the second inner surface of the second recess to the outer diameter surface, and wherein the second support recess thickness may comprise at least the minimum thickness. The second recess may be sized and shaped to maintain the minimum thickness of the second support recess thickness.

In various embodiments, a gas turbine engine is disclosed. The gas turbine engine may comprise a compressor section; and a turbine section. The turbine section may comprise: a stator vane having an anti-rotation end, and a vane support. The vane support may comprise: an inner diameter surface opposite an outer diameter surface; an anti-rotation lug defining a protrusion extending from the inner diameter surface, wherein the anti-rotation lug comprises a first surface opposite a second surface, and wherein the anti-rotation lug is configured to interface with the anti-rotation end of the stator vane; a first recess defining a first void on the inner diameter surface proximate the first surface of the anti-rotation lug, the first recess having a first inner surface; and a second recess defining a second void on the inner diameter surface proximate the second surface of the anti-rotation lug, the second recess having a second inner surface.

In various embodiments, the anti-rotation end of the stator vane may comprise a first protrusion and a second protrusion extending radially from the anti-rotation end towards the vane support, wherein the first protrusion and the second protrusion may define an anti-rotation void. The anti-rotation lug of the vane support may be configured to interface with the anti-rotation void of the stator vane to at least partially limit rotation of the stator vane relative to the vane support. In response to the anti-rotation lug interfacing with the anti-rotation void, the first protrusion may be configured to interface with the first recess and the second protrusion may be configured to interface with the second recess. At least one of the first inner surface of the first recess or the second inner surface of the second recess may comprise at least one of a flat surface or a hemispherical shaped surface relative to the inner diameter surface.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

Figure 1:
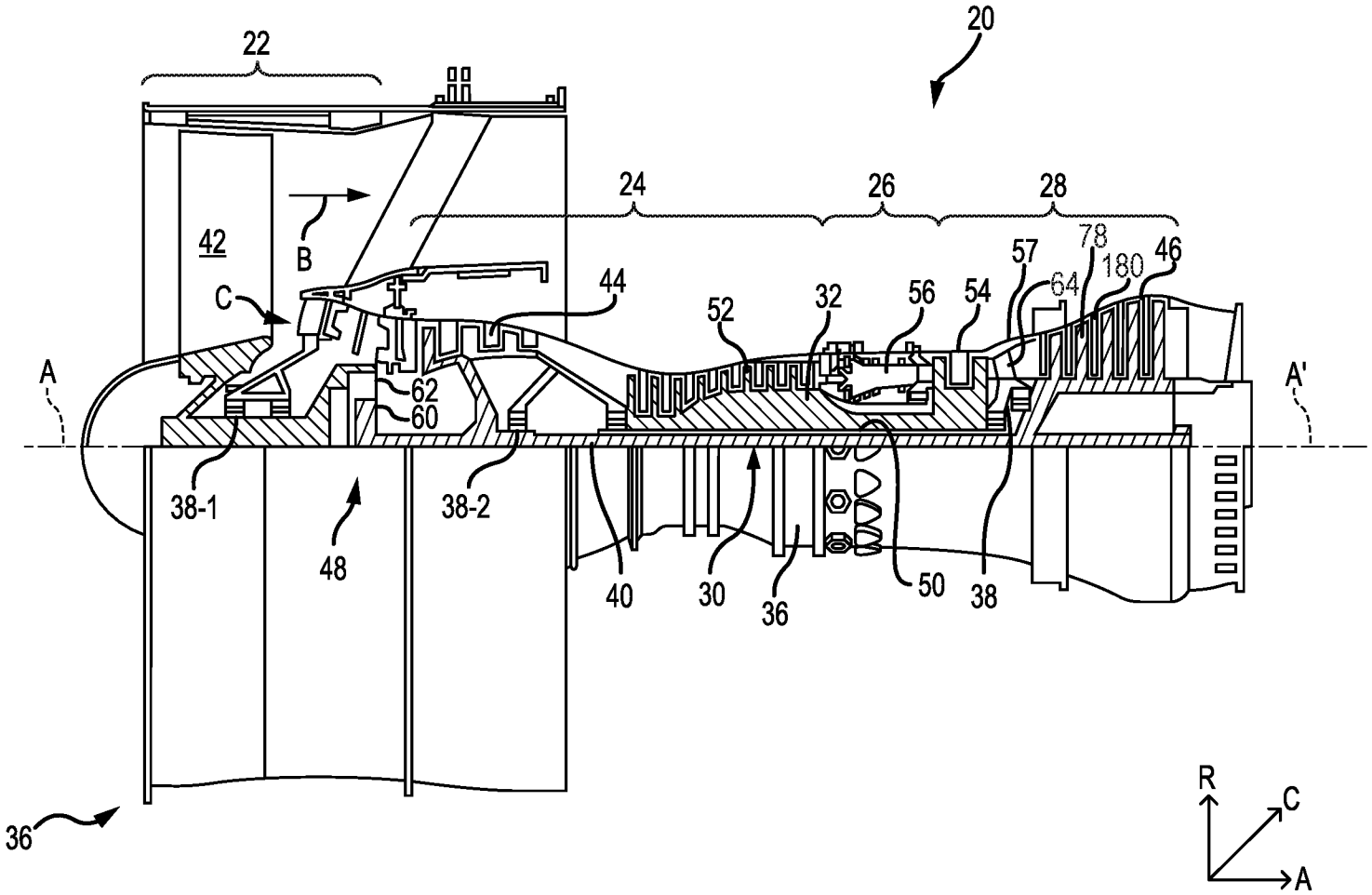
FIG. 1 illustrates a cross-sectional view of a gas turbine engine, in accordance with various embodiments.

In various embodiments, and with reference to FIG. 1, a gas turbine engine 20 is disclosed. As used herein, "aft" refers to the direction associated with a tail (e.g., the back end) of an aircraft, or generally, to the direction of exhaust of gas turbine engine 20. As used herein, "forward" refers to the direction associated with a nose (e.g., the front end) of the aircraft, or generally, to the direction of flight or motion. An A-R-C axis has been included throughout the figures to illustrate the axial (A), radial (R) and circumferential (C) directions. For clarity, axial axis A spans parallel to engine central longitudinal axis A-A'. As utilized herein, radially inward refers to the negative R direction towards engine central longitudinal axis A-A', and radially outward refers to the R direction away from engine central longitudinal axis A-A'.

Gas turbine engine 20 may comprise a two-spool turbofan that generally incorporates a fan section 22, a compressor section 24, a combustor section 26, and a turbine section 28. Gas turbine engine 20 may also comprise, for example, an augmenter section, and/or any other suitable system, section, or feature. In operation, fan section 22 may drive coolant (e.g., air) along a bypass flow-path B, while compressor section 24 may further drive coolant along a core flow-path C for compression and communication into combustor section 26, before expansion through turbine section 28. FIG. 1 provides a general understanding of the sections in a gas turbine engine, and is not intended to limit the disclosure. The present disclosure may extend to all types of applications and to all types of turbine engines, including, for example, turbojets, turboshafts, and three spool (plus fan) turbofans wherein an intermediate spool includes an intermediate pressure compressor ("IPC") between a low pressure compressor ("LPC") and a high pressure compressor ("HPC"), and an intermediate pressure turbine ("IPT") between the high pressure turbine ("HPT") and the low pressure turbine ("LPT").

In various embodiments, gas turbine engine 20 may comprise a low speed spool 30 and a high speed spool 32 mounted for rotation about an engine central longitudinal axis A-A' relative to an engine static structure 36 or an engine case via one or more bearing systems 38 (shown as, for example, bearing system 38-1 and bearing system 38-2 in FIG. 1). It should be understood that various bearing systems 38 at various locations may alternatively or additionally be provided, including, for example, bearing system 38, bearing system 38-1, and/or bearing system 38-2.

In various embodiments, low speed spool 30 may comprise an inner shaft 40 that interconnects a fan 42, a low pressure (or a first) compressor section 44, and a low pressure (or a second) turbine section 46. Inner shaft 40 may be connected to fan 42 through a geared architecture 48 that can drive fan 42 at a lower speed than low speed spool 30. Geared architecture 48 may comprise a gear assembly 58 enclosed within a gear housing 59. Gear assembly 58 may couple inner shaft 40 to a rotating fan structure. High speed spool 32 may comprise an outer shaft 50 that interconnects a high pressure compressor ("HPC") 52 (e.g., a second compressor section) and high pressure (or a first) turbine section 54. A combustor 56 may be located between HPC 52 and high pressure turbine 54. A mid-turbine frame 57 of engine static structure 36 may be located generally between high pressure turbine 54 and low pressure turbine 46. Mid-turbine frame 57 may support one or more bearing systems 38 in turbine section 28. Inner shaft 40 and outer shaft 50 may be concentric and may rotate via bearing systems 38 about engine central longitudinal axis A-A'. As used herein, a "high pressure" compressor and/or turbine may experience a higher pressure than a corresponding "low pressure" compressor and/or turbine.

In various embodiments, the coolant along core airflow C may be compressed by low pressure compressor 44 and HPC 52, mixed and burned with fuel in combustor 56, and expanded over high pressure turbine 54 and low pressure turbine 46. Mid-turbine frame 57 may comprise airfoils 64 located in core airflow path C. Low pressure turbine 46 and high pressure turbine 54 may rotationally drive low speed spool 30 and high speed spool 32, respectively, in response to the expansion.

In various embodiments, gas turbine engine 20 may be, for example, a high-bypass ratio geared engine. In various embodiments, the bypass ratio of gas turbine engine 20 may be greater than about six (6). In various embodiments, the bypass ratio of gas turbine engine 20 may be greater than ten (10). In various embodiments, geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low pressure turbine 46 may have a pressure ratio that is greater than about five (5). In various embodiments, the bypass ratio of gas turbine engine 20 is greater than about ten (10:1). In various embodiments, the diameter of fan 42 may be significantly larger than that of the low pressure compressor 44, and the low pressure turbine 46 may have a pressure ratio that is greater than about five (5:1). Low pressure turbine 46 pressure ratio may be measured prior to inlet of low pressure turbine 46 as related to the pressure at the outlet of low pressure turbine 46 prior to an exhaust nozzle. It should be understood, however, that the above parameters are exemplary of various embodiments of a suitable geared architecture engine and that the present disclosure contemplates other gas turbine engines including direct drive turbofans.

The next generation turbofan engines are designed for higher efficiency and use higher pressure ratios and higher temperatures in high pressure compressor 52 than are conventionally experienced. These higher operating temperatures and pressure ratios create operating environments that cause thermal loads that are higher than the thermal loads conventionally experienced, which may shorten the operational life of current components.

In various embodiments, high pressure turbine 54 may comprise alternating rows of rotary airfoils or rotor blades 78 and stator vanes 180. Rotor blades 78 may rotate relative to engine central longitudinal axis A-A'. Stator vanes 180 may be stationary and may be coupled to an inner engine structure, as discussed further herein. Stator vane 180 may be monolithic. Stator vanes 180 may interface with various gas turbine engine 20 components to provide support to stator vanes 180, to at least partially limit rotation in each stator vane 180 relative to engine central longitudinal axis A-A', and to allow for thermal expansion of stator vanes 180 during gas turbine engine 20 operation. In that regard, and in various embodiments, and with reference to FIG. 2A, a portion of high pressure turbine 54 (e.g., a turbine assembly) comprising a vane support 100 (e.g., a stator vane support) interfacing with one or more stator vanes 180 is depicted.

In various embodiments, stator vanes 180 maybe located between vane support 100 and an inner engine structure, and may be arranged circumferentially about engine central longitudinal axis A-A', with brief reference to FIG. 1. Stator vanes 180 may each comprise a base 185 radially opposite an anti-rotation end 190. Base 185 may be configured to couple each stator vane 180 to an inner engine structure. Each anti-rotation end 190 may be configured to interface with vane support 100. In that respect, each anti-rotation end 190 may comprise one or more features configured to interface with vane support 100. For example, each anti-rotation end 190 may comprise a first protrusion 192 and a second protrusion 197. First protrusion 192 may define a first portion of anti-rotation end 190 that extends in a radial direction from anti-rotation end 190, towards vane support 100. Second protrusion 197 may define a second portion of anti-rotation end 190 proximate first protrusion 192 that extends in a radial direction from anti-rotation end 190, towards vane support 100. First protrusion 192 and second protrusion 197 may be configured to interface with an anti-rotation lug 110 of vane support 100 to at least partially limit rotation of each stator vane 180 in the circumferential direction, as discussed further herein.

Anti-rotation end 190 may comprise an anti-rotation void 195 defining a recess between first protrusion 192 and second protrusion 197. In that regard, first protrusion 192 and second protrusion 197 may at least partial define anti-rotation void 195 together with anti-rotation end 190. Anti-rotation void 195 may be configured to receive anti-rotation lug 110 in response to the corresponding stator vane 180 interfacing with vane support 100. Anti-rotation void 195 may be sized and shaped to receive anti-rotation lug 110. For example, anti-rotation void 195 may comprise a size and shape to allow a radial gap to form between inner surfaces of anti-rotation void 195 and an outer surface of anti-rotation lug 110, in response to anti-rotation lug 110 interfacing with anti-rotation void 195.

In various embodiments, vane support 100 may be located between stator vanes 180 and an outer engine casing, and may be arranged circumferentially about engine central longitudinal axis A-A', with brief reference to FIG. 1. Vane support 100 may comprise a single hoop, extending in a circumferential direction about engine central longitudinal axis A-A', with brief reference to FIG. 1. Vane support 100 may comprise an inner diameter surface 105 radially opposite an outer diameter surface 107. Outer diameter surface 107 may be configured to couple vane support 100 to an outer engine case structure. Inner diameter surface 105 may be configured to interface with stator vanes 180, as discussed further herein.

Figure 2A:
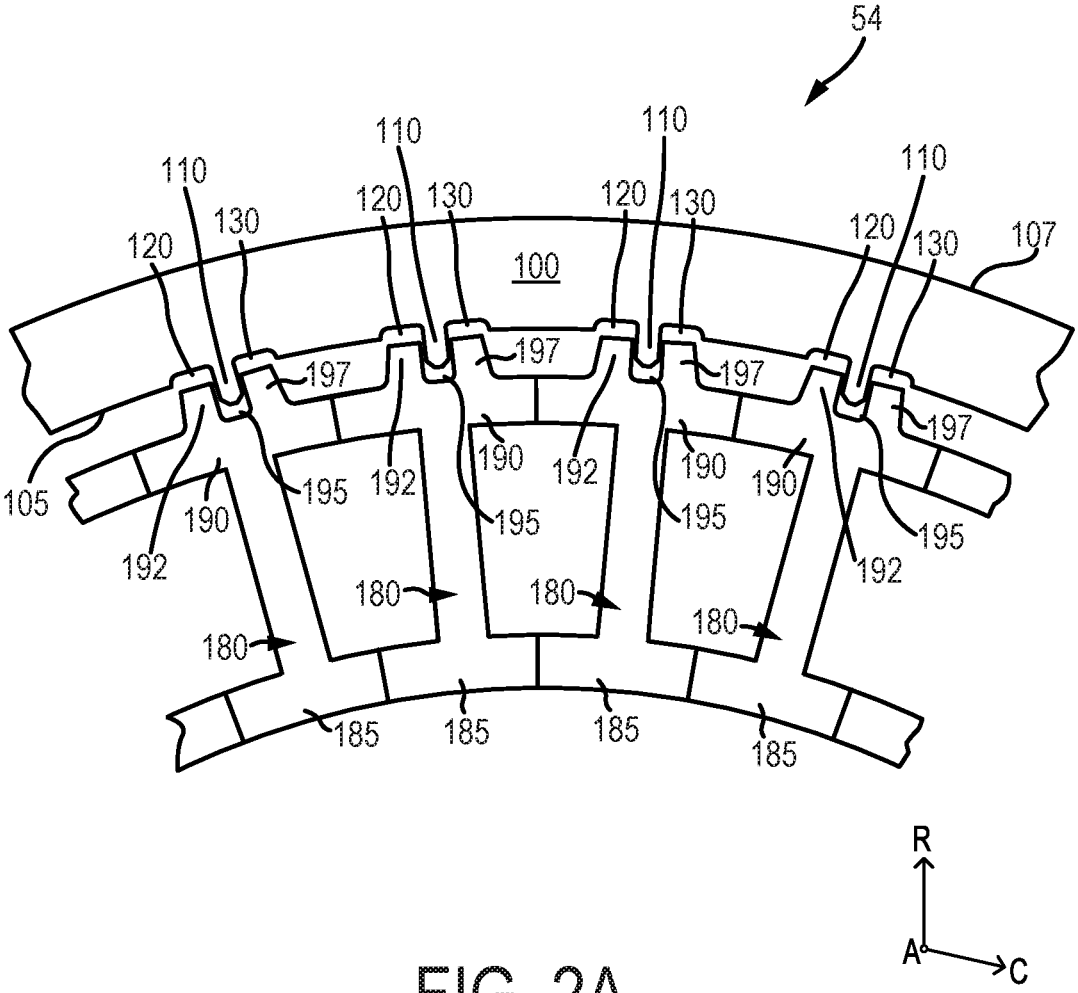
FIG. 2A illustrates a forward to aft cross-sectional view of a portion of a high pressure turbine section of a gas turbine engine, in accordance with various embodiments.
Figure 2B:
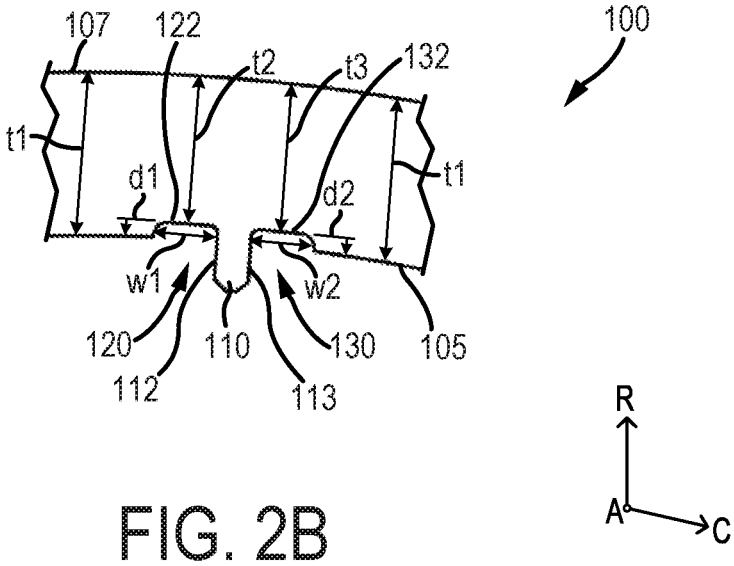
FIG. 2B illustrates a cross-sectional view of a vane support having anti-rotation features, in accordance with various embodiments.

With references to FIGS. 2A and 2B, vane support 100 may comprise one or more anti-rotation lugs 110. Anti-rotation lugs 110 may define a protrusion on inner diameter surface 105, extending radially inward towards stator vanes 180. Anti-rotation lugs 110 may comprise a first lug surface 112 (e.g., a first surface) circumferentially opposite a second lug surface 113 (e.g., a second surface). Vane support 100 may comprise any suitable number of anti-rotation lugs 110. For example, vane support 100 may comprise an equal number of anti-rotation lugs 110 and stator vanes 180. Anti-rotation lugs 110 may be configured to interface with each corresponding anti-rotation void 195 to at least partially limit rotation in stator vane 180. For example, in response to movement from stator vanes 180 in the circumferential direction, at least one of first protrusion 192 or second protrusion 197 may contact anti-rotation lug 110 to at least partially limit stator vane 180 rotation in the circumferential direction.

In various embodiments, vane support 100 may comprise one or more thermal growth recesses 120, 130 configured to allow stator vane 180 to radially expand. For example, during gas turbine engine operation, stator vanes 180 may thermally expand in the radial direction (e.g., towards vane support 100) relative to the coupling of each base 185 to an inner engine structure. In that respect, vane support 100 may comprise a first thermal growth recess 120 (e.g., a first recess) and a second thermal growth recess 130 (e.g., a second recess). First thermal growth recess 120 may define a void on inner diameter surface 105 of vane support 100 proximate first lug surface 112 of anti-rotation lug 110. First thermal growth recess 120 may comprise a first recess inner surface 122 (e.g., a first inner surface). First thermal growth recess 120 may be configured to interface with first protrusion 192 of stator vane 180, in response to anti-rotation lug 110 interfacing with anti-rotation void 195 of stator vane 180. In that respect, first thermal growth recess 120 may be configured to allow stator vane 180 to thermally expand without obstructing first protrusion 192. Second thermal growth recess 130 may define a void on inner diameter surface 105 of vane support 100 proximate second lug surface 113 of anti-rotation lug 110. Second thermal growth recess 130 may comprise a second recess inner surface 132 (e.g., a second inner surface). Second thermal growth recess 130 may be configured to interface with second protrusion 197 of stator vane 180, in response to anti-rotation lug 110 interfacing with anti-rotation void 195 of stator vane 180. In that respect, second thermal growth recess 130 may be configured to allow stator vane 180 to thermally expand without obstructing second protrusion 197.

In various embodiments, and with specific reference to FIG. 2B, various dimensions of vane support 100 are depicted in greater detail. Vane support 100 may comprise a vane support thickness t1. Vane support thickness t1 may define a distance from inner diameter surface 105 to outer diameter surface 107.

In various embodiments, first thermal growth recess 120 may comprise a first recess depth d1 and a first recess width w1. First recess depth d1 may define a depth of first thermal growth recess 120 measured from inner diameter surface 105 to first recess inner surface 122 of first thermal growth recess 120. First recess width w1 may define a width of first thermal growth recess 120 measured from first lug surface 112 of anti-rotation lug 110 to an outer circumferential edge of first thermal growth recess 120. First recess depth d1 and first recess width w1 may comprise any suitable size and shape capable of providing thermal growth clearance to stator vane 180.

In various embodiments, first recess depth d1 may be sized to maintain a minimum thickness in vane support 100. For example, vane support 100 may comprise a first vane support recess thickness t2. First vane support recess thickness t2 may define a distance from first recess inner surface 122 of first thermal growth recess 120 to outer diameter surface 107. In that regard, first vane support recess thickness t2 together with first recess depth d1 may be equal to vane support thickness t1. Due at least partially to operational constraints, structural limitations, or the like, first vane support recess thickness t2 may comprise a minimum thickness needed to meet such constraints. For example, a minimum thickness may be defined as a minimum distance in first vane support recess thickness t2 needed to maintain structural integrity in vane support 100 during gas turbine engine operation. For example, first vane support recess thickness t2 may comprise at least a thickness of about 0.035 inch (0.889 mm) to about 0.040 inch (1.016 mm), about 0.040 inch (1.016 mm) to about 0.050 inch (1.27 mm), or about 0.050 inch (1.27 mm) to about 0.075 inch (1.905 mm) (wherein about as used in this context refers only to +/−0.005 inch (0.127 mm)).

In various embodiments, second thermal growth recess 130 may comprise a second recess depth d2 and a second recess width w2. Second recess depth d2 may define a depth of second thermal growth recess 130 measured from inner diameter surface 105 to second recess inner surface 132 of second thermal growth recess 130. Second recess width w2 may define a width of second thermal growth recess 130 measured from second lug surface 113 of anti-rotation lug 110 to an outer circumferential edge of second thermal growth recess 130. Second recess depth d2 and second recess width w2 may be similar to first recess depth d1 and first recess width w1. Second recess depth d2 and second recess width w2 may comprise any suitable size capable of providing thermal growth clearance to stator vane 180.

In various embodiments, second recess depth d2 may be sized to maintain a minimum thickness in vane support 100. For example, vane support 100 may comprise a second vane support recess thickness t3. Second vane support recess thickness t3 may define a distance from second recess inner surface 132 of second thermal growth recess 130 to outer diameter surface 107. Second vane support recess thickness t3 may be similar to first vane support recess thickness t2. In that regard, second vane support recess thickness t3 together with second recess depth d2 may be equal to vane support thickness t1. Due at least partially to operational constraints, structural limitations, or the like, second vane support recess thickness t3 may comprise a minimum thickness needed to meet such constraints. For example, a minimum thickness may be defined a minimum distance in second vane support recess thickness t3 needed to maintain structural integrity in vane support 100 during gas turbine engine operation. For example, second vane support recess thickness t3 may comprise at least a thickness of about 0.035 inch (0.889 mm) to about 0.040 inch (1.016 mm), about 0.040 inch (1.016 mm) to about 0.050 inch (1.27 mm), or about 0.050 inch (1.27 mm) to about 0.075 inch (1.905 mm) (wherein about as used in this context refers only to +/−0.005 inch (0.127 mm)).

In various embodiments, and with reference again to FIGS. 2A and 2B, first thermal growth recess 120 and second thermal growth recess 130 may be formed using any suitable technique. For example, first thermal growth recess 120 and second thermal growth recess 130 may be formed using a milling machine, such as a horizontal mill, an end mill, a ball-end mill, or the like. First thermal growth recess 120 and second thermal growth recess 130 may also be formed using a computer-aided milling machine. In various embodiments, the type of mill used to form first thermal growth recess 120 and/or second thermal growth recess 130 may at least partially determine the shape and size of each respective recess. In various embodiments, first thermal growth recess 120 and/or second thermal growth recess 130 may also comprise any suitable shape or size capable of allowing anti-rotation end 190 of stator vane 180 to thermally expand. For example, first recess inner surface 122 of first thermal growth recess 120 may comprise a flat surface relative to inner diameter surface 105. Second recess inner surface 132 of second thermal growth recess 130 may also comprise a flat surface relative to inner diameter surface 105.

Figure 3:
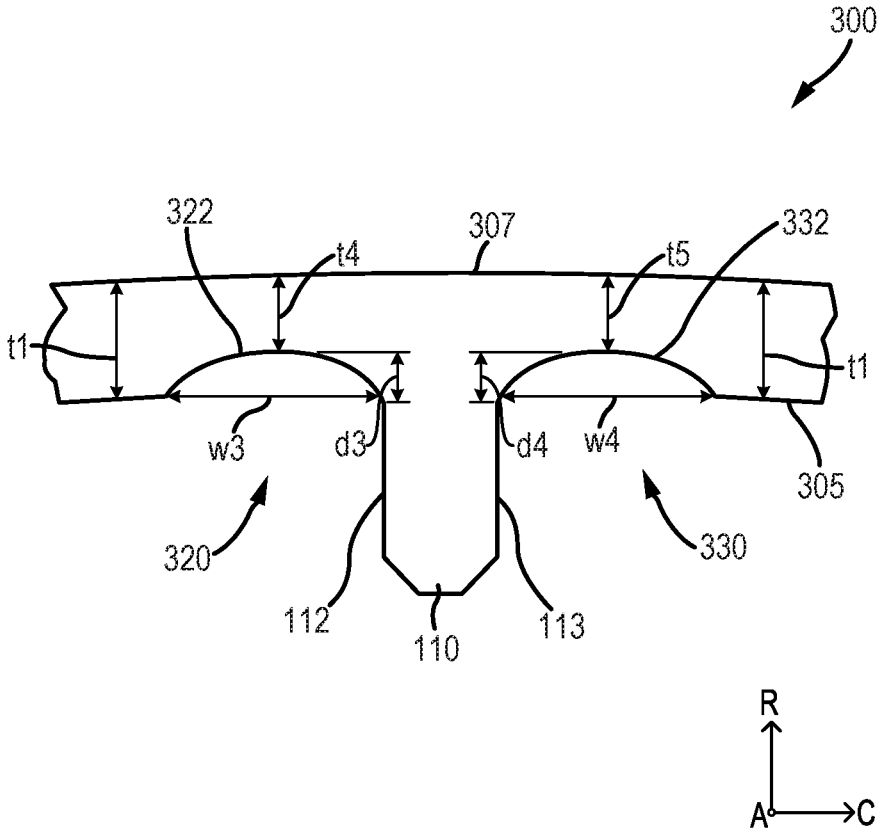
FIG. 3 illustrates a cross-sectional view of a vane support having hemispherical shaped thermal growth recesses, in accordance with various embodiments.

As a further example, and in accordance with various embodiments, and with reference to FIG. 3, a vane support 300 may comprise one or more thermal growth recesses having hemispherical shapes. Vane support 300 may comprise a first thermal growth recess 320 and a second thermal growth recess 330. First thermal growth recess 320 may be similar to first thermal growth recess 120, with brief reference to FIGS. 2A and 2B. First thermal growth recess 320 may define a void on an inner diameter surface 305 of vane support 300 proximate anti-rotation lug 110. First thermal growth recess 320 may comprise a first recess inner surface 322 (e.g., a first recess). First thermal growth recess 320 may be configured to interface with first protrusion 192 of stator vane 180, in response to anti-rotation lug 110 interfacing with anti-rotation void 195 of stator vane 180, with brief reference to FIG. 2A. First recess inner surface 322 of first thermal growth recess 320 may comprise a hemispherical shape relative to inner diameter surface 305. Second thermal growth recess 330 may be similar to second thermal growth recess 130, with brief reference to FIGS. 2A and 2B. Second thermal growth recess 330 may define a void on inner diameter surface 305 of vane support 300 proximate anti-rotation lug 110. Second thermal growth recess 330 may comprise a second recess inner surface 332 (e.g., a second recess). Second thermal growth recess 330 may be configured to interface with second protrusion 197 of stator vane 180, in response to anti-rotation lug 110 interfacing with anti-rotation void 195 of stator vane 180, with brief reference to FIG. 2A. Second recess inner surface 332 of second thermal growth recess 330 may comprise a hemispherical shape relative to inner diameter surface 305.

Vane support 300 may comprise a vane support thickness t1. Vane support thickness t1 may define a distance from inner diameter surface 305 to outer diameter surface 307. In various embodiments, first thermal growth recess 320 may comprise a first recess depth d3 and a first recess width w3. First recess depth d3 may define a depth of first thermal growth recess 320 measured from inner diameter surface 305 to first recess inner surface 322 of first thermal growth recess 320. First recess depth d3 may be similar to first recess depth d1, with brief reference to FIG. 2B, and may comprise similar dimensions disclosed herein. First recess width w3 may define a width of first thermal growth recess 320 measured from first lug surface 112 of anti-rotation lug 110 to an outer circumferential edge of first thermal growth recess 320. First recess width w3 may be similar to first recess width w1, with brief reference to FIG. 2B, and may comprise similar dimensions disclosed herein.

In various embodiments, first recess depth d3 may be sized to maintain a minimum thickness in vane support 300. For example, vane support 300 may comprise a first vane support recess thickness t4. First vane support recess thickness t4 may define a distance from first recess inner surface 322 of first thermal growth recess 320 to outer diameter surface 307. In that regard, first vane support recess thickness t4 together with first recess depth d3 may be equal to vane support thickness t1. Due at least partially to operational constraints, structural limitations, or the like, first vane support recess thickness t4 may comprise a minimum thickness needed to meet such constraints. For example, a minimum thickness may be defined as a minimum distance in first vane support recess thickness t4 needed to maintain structural integrity in vane support 300 during gas turbine engine operation. First vane support recess thickness t4 may be similar to first vane support recess thickness t2, with brief reference to FIG. 2B, and may comprise similar dimensions disclosed herein.

In various embodiments, second thermal growth recess 330 may comprise a second recess depth d4 and a second recess width w4. Second recess depth d4 may define a depth of second thermal growth recess 330 measured from inner diameter surface 305 to second recess inner surface 332 of second thermal growth recess 330. Second recess depth d4 may be similar to second recess depth d2, with brief reference to FIG. 2B, and may comprise similar dimensions disclosed herein. Second recess width w4 may define a width of second thermal growth recess 330 measured from second lug surface 113 of anti-rotation lug 110 to an outer circumferential edge of second thermal growth recess 330. Second recess width w4 may be similar to second recess width w2, with brief reference to FIG. 2B, and may comprise similar dimensions disclosed herein.

In various embodiments, second recess depth d4 may be sized to maintain a minimum required thickness in vane support 300. For example, vane support 300 may comprise a second vane support recess thickness t5. Second vane support recess thickness t5 may define a distance from second recess inner surface 332 of second thermal growth recess 330 to outer diameter surface 307. In that regard, second vane support recess thickness t5 together with second recess depth d4 may be equal to vane support thickness t1. Due at least partially to operational constraints, structural limitations, or the like, second vane support recess thickness t5 may comprise a minimum thickness needed to meet such constraints. For example, a minimum thickness may be defined as a minimum distance in second vane support recess thickness t5 needed to maintain structural integrity in vane support 300 during gas turbine engine operation. Second vane support recess thickness t5 may be similar to second vane support recess thickness t3, with brief reference to FIG. 2B, and may comprise similar dimensions disclosed herein.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosures is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A turbine assembly, comprising:

a plurality of stator vanes, each stator vane in the plurality of stator vanes being monolithic, each stator vane in the plurality of stator vanes comprising:

a base coupled to an inner engine structure;

a vane; and an anti-rotation end disposed radially outward from the base, the vane extending from the base to the anti-rotation end, the anti-rotation end defining a radially outer surface, the anti-rotation end comprising a first protrusion extending radially outward from the radially outer surface, a second protrusion extending radially outward from the radially outer surface and disposed circumferentially adjacent to each first protrusion, and an anti-rotation recess defining an anti-rotation void, the anti-rotation recess disposed between, and defined by, each first protrusion and each second protrusion; and a vane support, comprising:

an inner diameter surface opposite an outer diameter surface;

a plurality of anti-rotation lugs, each anti-rotation lug defining a protrusion extending from the inner diameter surface, wherein each anti-rotation lug comprises a first surface opposite a second surface, wherein each anti-rotation lug is configured to interface with the anti-rotation end of an adjacent stator vane in the plurality of stator vanes, and wherein each anti-rotation lug is disposed within the anti-rotation recess of the adjacent stator vane and between each first protrusion and each second protrusion of the adjacent stator vane;

a plurality of first recesses, each first recess defining a first void on the inner diameter surface proximate the first surface of an adjacent anti-rotation lug in the plurality of anti-rotation lugs, each first recess having a first inner surface; and a plurality of second recesses, each second recess defining a second void on the inner diameter surface proximate the second surface of the adjacent anti-rotation lug in the plurality of anti-rotation lugs, each second recess having a second inner surface, wherein:

the first inner surface of each first recess and the second inner surface of each second recess comprise a hemispherical shaped surface relative to the inner diameter surface, and each stator vane in the plurality of stator vanes is configured to thermally expand in a radial direction relative to the base and reduce a gap between the anti-rotation void of each stator vane in the plurality of stator vanes and an adjacent anti-rotation lug.

2. The turbine assembly of claim 1, wherein each anti-rotation lug of the vane support is configured to interface with each anti-rotation void of each stator vane to at least partially limit rotation of each stator vane relative to the vane support.

3. The turbine assembly of claim 2, wherein in response to each anti-rotation lug interfacing with each anti-rotation void, each first protrusion is configured to interface with each first recess and each second protrusion is configured to interface with each second recess.

4. The turbine assembly of claim 1, wherein the vane support comprises a first support recess thickness defining a first distance from the first inner surface of each first recess to the outer diameter surface, and wherein the first support recess thickness comprises at least a minimum thickness.

5. The turbine assembly of claim 4, wherein each first recess is sized and shaped to maintain the minimum thickness of the first support recess thickness.

6. The turbine assembly of claim 1, wherein the vane support comprises a second support recess thickness defining a second distance from the second inner surface of each second recess to the outer diameter surface, and wherein the second support recess thickness comprises at least a minimum thickness.

7. The turbine assembly of claim 6, wherein each second recess is sized and shaped to maintain the minimum thickness of the second support recess thickness.

8. A gas turbine engine, comprising:

a compressor section; and a turbine section, wherein the turbine section comprises:

a plurality of stator vanes, each stator vane in the plurality of stator vanes being monolithic, each stator vane in the plurality of stator vanes comprising:

a base coupled to an inner engine structure;

a vane;

an anti-rotation end disposed radially outward from the base, the vane extending from the base to the anti-rotation end, the anti-rotation end defining a radially outer surface, the anti-rotation end comprising a first protrusion extending radially outward from the radially outer surface, a second protrusion extending radially outward from the radially outer surface and disposed circumferentially adjacent to each first protrusion, and an anti-rotation recess defining an anti-rotation void, the anti-rotation recess disposed between, and defined by, each first protrusion and each second protrusion; and a vane support, comprising:

an inner diameter surface opposite an outer diameter surface;

a plurality of anti-rotation lugs, each anti-rotation lug defining a protrusion extending from the inner diameter surface, wherein each anti-rotation lug comprises a first surface opposite a second surface, wherein each anti-rotation lug is configured to interface with the anti-rotation end of an adjacent stator vane in the plurality of stator vanes, and wherein each anti-rotation lug is disposed within the anti-rotation recess of the adjacent stator vane and between each first protrusion and each second protrusion of the adjacent stator vane;

a plurality of first recesses, each first recess defining a first void on the inner diameter surface proximate the first surface of an adjacent anti-rotation lug in the plurality of anti-rotation lugs, each first recess having a first inner surface; and a plurality of second recesses, each second recess defining a second void on the inner diameter surface proximate the second surface of the adjacent anti-rotation lug, each second recess having a second inner surface, wherein:

the first inner surface of each first recess and the second inner surface of each second recess comprise a hemispherical shaped surface relative to the inner diameter surface, and each stator vane in the plurality of stator vanes is configured to thermally expand in a radial direction relative to the base and reduce a gap between the anti-rotation void of each stator vane in the plurality of stator vanes and an adjacent anti-rotation lug.

9. The gas turbine engine of claim 8, wherein each anti-rotation lug of the vane support is configured to interface with each anti-rotation void of each stator vane to at least partially limit rotation of each stator vane relative to the vane support.

10. The gas turbine engine of claim 9, wherein in response to each anti-rotation lug interfacing with each anti-rotation void, each first protrusion is configured to interface with each first recess and each second protrusion is configured to interface with each second recess.

* * * * *